United States Patent [19]

Meyerhoefer

[11] 3,949,472

[45] Apr. 13, 1976

[54] SELF CLEANING DRY-SHAVER

[76] Inventor: Carl E. Meyerhoefer, 264-30 60th Ave., Little Neck, N.Y. 11362

[22] Filed: Feb. 18, 1975

[21] Appl. No.: 550,185

[52] U.S. Cl. ..... 30/41.5; 30/34 R; 30/34.1

[51] Int. Cl.[2] ..... B26B 19/44

[58] Field of Search ..... 30/34 R, 34.1, 41.5, 90

[56] References Cited

UNITED STATES PATENTS

| | | | |
|---|---|---|---|
| 2,245,917 | 6/1941 | Hill | 30/41.5 |
| 2,878,499 | 3/1959 | Pressman | 30/34 R X |
| 3,143,796 | 8/1964 | Bond | 30/34 R |
| 3,290,774 | 12/1966 | Schuessler | 30/34.1 |

*Primary Examiner*—Al Lawrence Smith
*Assistant Examiner*—Gary L. Smith
*Attorney, Agent, or Firm*—Kane, Dalsimer, Kane, Sullivan and Kurucz

[57] ABSTRACT

A self-cleaning dry shaver is disclosed having a reel-type rotary blade and a retractable guard for the perforated shear plate. With the guard retracted, cuttings and other debris removed during the shaving procedure are collected in a chamber within the dry shaver housing. After use, and while the blades are rotating, the retractable guard is withdrawn from the shaver housing to cover and close the perforated shear plate, while opening axial air inlet ports. Simultaneously with this act, the cuttings and other shaving debris are expelled from the collection chamber to the atmosphere through a conduit which is opened by withdrawal of the retractable guard from the shaver housing.

9 Claims, 9 Drawing Figures

Fig. 2
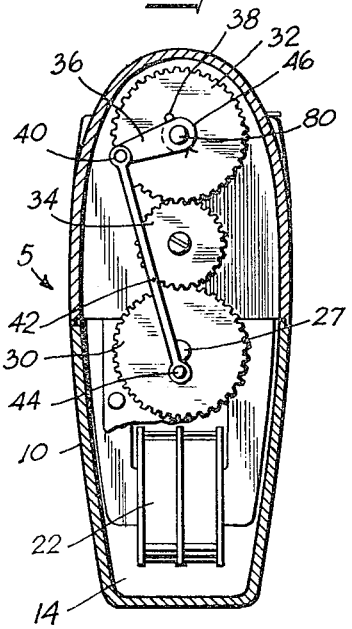
Fig. 1
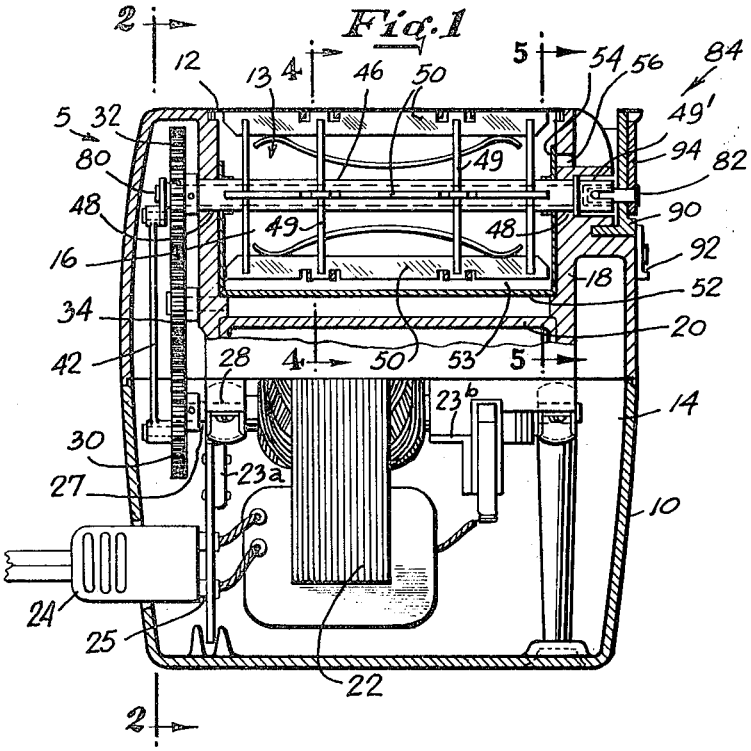
Fig. 3
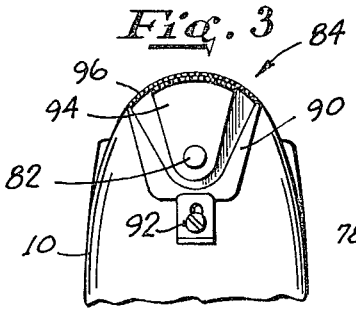
Fig. 5
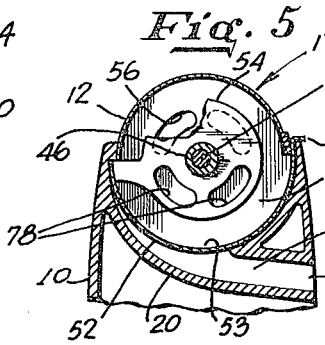
Fig. 6
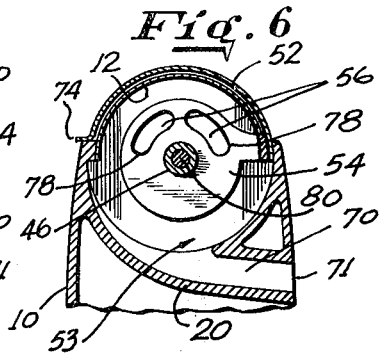
Fig. 4
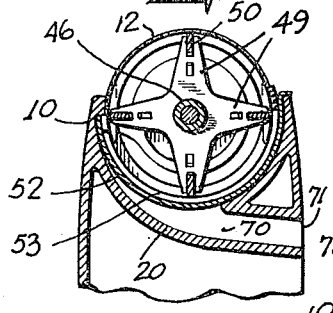
Fig. 4a
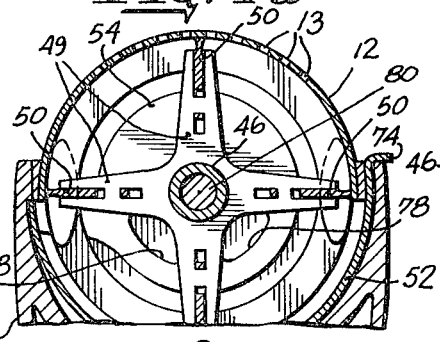
Fig. 8
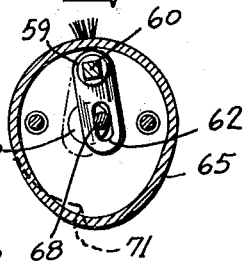
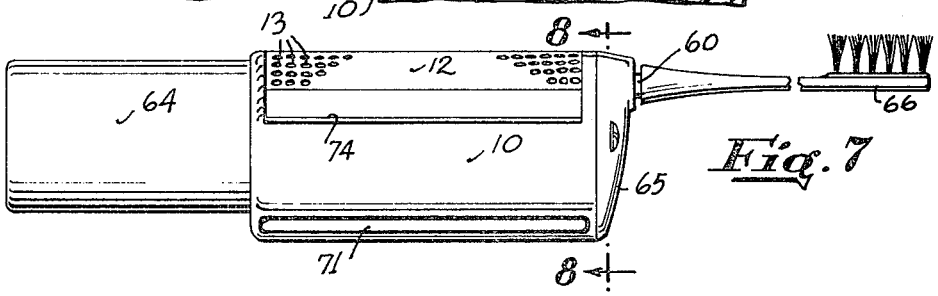
Fig. 7

SELF CLEANING DRY-SHAVER

BACKGROUND OF THE INVENTION

1. Field of the Invention

The invention relates to dry shavers and more particularly concerns a dry shaver having a reel-type rotating cutter within a housing and a means for automatically collecting and discharging cutting debris.

2. Brief Description of the Prior Art

Reel types of rotary cutting dry shavers have been known for many years in a variety of forms. Representative of patents disclosing reel-type rotary dry shavers are U.S. Pat. Nos. 1,659,184; 1,730,004; 2,229,971; 2,323,745; 2,332,405; 2,601,722; 2,890,522; 3,047,944; 3,494,031; and 3,596,353.

The combination of a reel-type cutter dry shaver and a retractable, integral shear plate guard has also been known prior to my invention; see for example U.S. Pat. No. 3,143,796. Dry shavers disclosing means for collecting the cuttings and automatically expelling the same by force of air have been disclosed in a large number of patents. Representative of the most relevant art are U.S. Pat. Nos. 2,461,858; 2,323,745; 2,669,016; and 3,634,935.

The dry shaver of my invention provides a reel-type rotary blade which serves to cut whiskers smoothly and without pulling or pinching the same. The rotating blades also serve to power a means for automatically cleaning the shaver device after it has been used. Unlike the prior art self-cleaning shavers, the shaver of my invention does not require a separate vacuum or other means for creating an air draft to clean the shaver. The power of the rotating cutting blade is utilized for this purpose. The advantage is a more efficient, less costly and simpler construction. For example, no (additional) moving parts are required solely to cool and clean the razor. The air power of the rotary blades themselves are utilized for this function.

SUMMARY OF THE INVENTION

The invention comprises a dry shaver including in combination: a housing; a hollow interior portion of said housing; an open end of said housing exposing said hollow portion to the atmosphere; a perforated shear plate supported by said housing at said open end; a chamber including said interior portion defined by said shear plate and said housing; a reel-type cutting blade supported by said housing within said chamber, for rotation about its longitudinal axis with a peripheral portion thereof in rubbing contact with said shear plate; means for rotating said reel; a conduit communicating between the exterior of said housing and said chamber at a zone of said chamber diametrically opposed to said shear plate; a bore communicating said chamber with the atmosphere at a zone of said chamber adjacent an end of said reel and on the longitudinal axis thereof; a cover movably mounted on said housing, a first position of said cover being over the exterior of said shear plate whereby access to said chamber through the perforations thereof is closed and access to said chamber through said conduit is provided, a second position of said cover being within said housing whereby access to said chamber through said conduit is closed and access to said chamber through the perforations of said shear plate is provided; and means associated with said cover to open said bore when said cover is in said first position and to close said bore when said cover is in said second position.

BRIEF DESCRIPTION OF THE DRAWINGS

FIG. 1 is a cross-sectional side elevation of an embodiment of the invention.

FIG. 2 is a view along lines 2—2 of FIG. 1.

FIG. 3 is an end view of FIG. 1.

FIG. 4 is a view along lines 4—4 of FIG. 1.

FIG. 4*a* is an enlarged view as seen in FIG. 4.

FIG. 5 is a view along lines 5—5 of FIG. 1 showing the cover in a retracted position.

FIG. 6 is a view as in FIG. 5 but with the cover closing the shear plate.

FIG. 7 is a side elevation of an alternate embodiment of the invention.

FIG. 8 is a cross-sectional view along lines 8—8 of FIG. 7.

DESCRIPTION OF THE PREFERRED EMBODIMENTS

For convenience, the dry shaver of the invention may be described with reference to the drawings of FIGS. 1 through 8 inclusive, which accompany this description.

FIG. 1 is a cross-sectional side elevation of an embodiment shaver 5 of the invention and shows a housing 10 upon one end of which there is mounted perforated shear plate 12. Shear plate 12 covers an opening 13 into the interior of the housing 10. The interior of housing 10 is divided into a first interior chamber 14 and a second interior chamber 16 by lateral support members 18 and partition 20. Lateral support members 18 and partition 20 are preferably integral molded portions of housing 10. Contained within the first interior chamber 14 there is seen an electric motor 22 mounted on the housing by support brackets 23*a* dnd 23*b* and powered by an electric power supply (not shown) via power cord 24 attached to terminals 25. The electric motor 22 provides rotational power to shaft 27 which is attached at one end to motor 22 and is journaled 28 at its other end to support 23*a*. The end of shaft 27 distal to motor 22 is connected to and rotationally drives spur gear 30. Spur gear 30 is a part of a gear train which comprises pinion gear 32 which is driven by idler spur gear 34 and which in turn is driven by spur gear 30. Those skilled in the art will appreciate that alternate gear trains may be employed to transmit power between the motor 22 and the shaft 46 to which pinion gear 32 is connected.

The gear train is readily seen in greater detail in FIG. 2. FIG. 2 is a cross-sectional view along lines 2—2 of FIG. 1. As shown in FIG. 1 and in FIG. 2, rotation of spur gear 30 serves to ultimately rotate drive shaft 46. Drive shaft 46 is shown to be a hollow tube, for a preferred embodiment described hereinafter. However, shaft 46 may be a solid shaft. Referring again to FIG. 1, it is seen that shaft 46 is journaled 48 on support members 18 so that its longitudinal axis traverses the second interior chamber 16 of housing 10 and is thereby enclosed by shear plate 12, support members 18, and partition 20 of housing 10. Supported on shaft 46 by brackets 49 are seen multiple cutting blades 50. The cutting blades 50 are arranged so that when they are rotated to a top position they make rubbing contact with shear plate 12. When blades 50 move to a lower position, they are out of contact with shear plate 12. As shown in FIG. 1, the retractable shear plate 12 cover 52 is retracted within housing 10 and occupies a position beneath the rotatable blades 50. There is a space 53 between cover 52 and the position of blades 50 at their lowest point upon rotation in chamber 16. Space 53 is a cutting debris collection zone. Integral with cover 52 is lateral extension 54 of the cover 52. The lateral extension rotates about the axis of shaft 46 when cover 52 is moved and is shown closing bores 56. Bores 56, when uncovered by extension 54 provide a means of communication between chamber 16 and the atmosphere. The function of bore 56 will be described hereinafter.

FIG. 5 is a cross-sectional view in part along lines 5—5 of FIG. 1 and shows the position of shaft 46 traversing the chamber 16. Chamber 16 is defined by perforated shear plate 12 mounted on the body of housing 10 by support member 18 and by partition 20. Conduit 70 connects chamber 16 with the atmosphere. Conduit 70 is located in a zone of chamber 16 which is diametrically opposed to shear plate 12. As shown in FIG. 5, the conduit 70 has been closed by retracted cover 52 which is shown movably positioned within the housing 10 beneath shaft 46 with its supported blades 50. Lateral extension 54 of cover 52 is shown to be a flat plate having apertures 78 therein. In the position of cover 52 illustrated in FIG. 5, i.e., wherein the cover 52 has been retracted into housing 10, and conduit 70 has been thereby closed, the shear plate 12 is exposed and the shaver 5 is operable (with power turned on) to cut beards, hair, etc., in a conventional manner. As hair is cut, the cuttings are conducted by the centrifugal force to deposit upon the upper surface of retracted cover 52. Upon completion of the cutting operation, cover 52 is tracted from housing 10 by manually lifting lip 74 and rotates over to cover shear plate 12 thereby closing opening 13 through the perforations of plate 12. Withdrawal of cover 52 from the housing 10 causes the debris collected on the upper surface of cover 52 to drop into the passage of conduit 70. Removal of cover 52 also serves to open conduit 70 to establish communication between chamber 16 and the atmosphere.

FIG. 6 is a view as seen in FIG. 5 but with cover 52 tracted out of the housing 10. Traction of cover 52 out of the housing as shown in FIG. 6, closes the perforations in shear plate 12 and serves to rotate the lateral extension 54 which is integral with cover 52, so that apertures 78 are now in alignment with bores 56. Bores 56 are opened and provide communication between the atmosphere and chamber 16. Thus, with the opening 13 (perforations of shear plate 12) closed, there is now a fluid communication through bores 56, chamber 16 and conduit 70. In this arrangement, and with the blades 50 rotating, the power of the rotating blades 50 draw air into chamber 16 through bore 56. This air circulates with force through chamber 16 and exhausts through the now open conduit 70 via portal 71. The force of the air rushing through chamber 16 and out of portal 71 carries with it the cutting debris dropped in conduit 70 so as to expel this debris out of the shaver 5. With opening 13 closed, a high vacuum in chamber 16 may be created by the rotating blades 50 and a high velocity current of air is drawn in bores 56 for discharge through conduit 70. In this manner, cutting debris is expelled from the body of shaver 5 automatically upon closing and covering the shear plate 12 with cover 52, while the blades 50 are rotating. The system is automatic and highly efficient. Additional vacuum components such as fans are not required. Those skilled in the art will appreciate that for optimum operation, the cover 52 should fit closely in its association with the housing 10, shear plate 12, etc., so as to provide substantially fluid tight joints therewith.

FIG. 4 is a cross-sectional view in part along lines 4—4 of FIG. 1 and shows in greater detail the structure of shaft 46 and mounted blades 50.

FIG. 4*a* is an enlarged view of FIG. 4 and shows in even greater detail the construction of supported blades 50 upon blade support 49 which is mounted on shaft 46. The blades 50 when rotated into a position where they contact shear plate 12 make rubbing contact thereat as shown in the FIG. 4*a* to shear whiskers pressed through the opening 13 of the perforated shear plate 12. Beneath the rotating radius of blades 50 is a debris collecting zone 53 on the upper surface of retracted cover 52. Cover 52 has a lip 74 for convenience in grasping to tract it from housing 10 to rotate and to cover shear plate 12 when it is desired to protect the shear plate or to clean the shaver body 5 of collected cutting debris as described above.

Preferred embodiments of the automatic self-cleaning shaver of the invention include one having a "power-take off" means for attaching tools operable by oscillation. FIG. 3 is a partial end view of the shaver 5 of FIG. 1, seen from its side distal to the power cord attachment and together with FIGS. 1 and 2 illustrates as an example, a tool for "trimming" hair.

Referring now to those figures, it will be seen that gear 30 carries an excentrically located pivot pin 44 together with a connecting link 42. A bell crank lever 36 is secured as with cotter pin 38 to a shaft 80 concentric with and passing through hollow shaft 46. Lever 36 carries a pivot pin 40 at its outer end and connecting link 42 is interposed between pins 40 and 44 respectively to complete a second drive assembly. The distance of pin 44 from the center of shaft 27 is made less than the distance of pin 40 from the center of shaft 46, thus an oscillating motion is imparted to shaft 80 when shaft 27 is moved in its usual rotating mode. The end of shaft 80 opposite lever 36 terminates in a coupling 49'. The latter may be a hollow cylindrical member, suitable to receive stub shaft 82 of trimmer 84. Shaft 82 may be provided with a cross pin 86 in driven engagement with slot 88 of coupling 49. Thus the oscillating motion of shaft 80 may be transmitted to trimmer 84 when desired. Trimmer 84 consists of a holder 90 which may be keyed to casing 10 and locked in place by retainer 92. Holder 90 suitably carries a cutter blade 94, secured to shaft 82. A safety guard 96 is attached to holder 90 in a manner to overlay cutter blade 94 and to cooperate therewith to trim hair. It will be apparent that trimmer assembly 84 may be removed simply by retracting retainer 92.

FIG. 7 shows an alternate form of the invention, which incorporates batteries as a source of energy and which may include an accessory such as a toothbrush to be driven by the same power source. A battery pack and a drive motor including suitable gear reduction are enclosed in a casing extnesion 64, which also conveniently serves as a handle. Housing 10' encloses chamber 16, the shaver blade reel assembly, exhaust conduit 70, port 71 and drive shaft 46. The latter extends beyond casing 10' and terminates in an excentric stub shaft 68 (FIG. 8). An oscillatable crank 58 is pivotted at fulcrum 59 which includes a square socket portion 60 and it is provided with an elongated opening 62 engaging shaft 68. An accessory attachment 66 terminates in a square end and may be plugged into socket 62. A cover 65 is bolted to casing 10' to enclose and retain the latter parts. It will be seen that rotation of shaft 46 will, through stub shaft 68 and crank 58, impart an oscillating motion to an accessory such as brush 66 when the latter is plugged into socket 62.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed:

1. A dry shaver including in combination, a casing assembly formed with a zone of openings therethrough and with air inlet and outlet openings, a primary motor driven shaft within said casing, an annular series of blades connected to said shaft to rotate therewith and shear hair extending through the zone openings into said assembly, said blades having solely uni-directional rotation to create a flow of air through said assembly to discharge air through the outlet opening of said casing when its openings are open and a movable cover mounted on said casing assembly for closing the air inlet and outlet openings, thereby interrupting said flow.

2. A dry shaver according to claim 1 wherein there is additionally included means for closing said zone openings when said air inlet opening is open.

3. A dry shaver including in combination, a casing assembly formed with a zone of openings therethrough and with air inlet and outlet openings, a primary motor driven shaft within said casing, an annular series of blades connected to said shaft to rotate therewith and shear hair extending through the zone openings into said assembly, said blades having solely uni-directional rotation to create a flow of air through said assembly to discharge air through the outlet opening of said casing when its openings are open and a movable cover mounted on said casing assembly for closing the air inlet and outlet openings, thereby interrupting said flow; said assembly including an impervious guard member pivoted around said shaft, having a protective cover portion and an air inlet port, said guard member being retractable within said casing assembly and cooperating therewith to provide a closed space for collecting shearings.

4. A dry shaver according to claim 3, wherein said guard member together with said casing assembly forms a blower housing scroll.

5. A dry shaver including in combination, a casing assembly formed with a zone of openings therethrough and with air inlet and outlet openings, a primary motor driven shaft within said casing, an annular series of blades connected to said shaft to rotate therewith and shear hair extending through the zone openings into said assembly, said blades having solely uni-directional rotation to create a flow of air through said assembly to discharge air through the outlet opening of said casing when its openings are open and a movable cover mounted on said casing assembly for closing the air inlet and outlet openings, thereby interrupting said flow; said shaft being hollow, a secondary shaft within the bore of said primary shaft and also connected to said motor to be oscillated thereby and connectable to an accessory tool extending externally of said casing assembly to perform other desired functions supplementary to said shearing.

6. A dry shaver including in combination, a housing; a hollow interior portion of said housing; an open end of said housing exposing said hollow portion to atmosphere; a shear plate with openings therethrough supported by said housing at said open end; a chamber including said interior portion defined by said shear plate and said housing; a reel-type cutting blade assembly supported by said housing within said chamber, for rotation about its longitudinal axis with a peripheral portion thereof in rubbing contact with said shear plate; means for rotating said reel; a conduit communicating between the exterior of said housing and said chamber, tangential to said reel; a bore communicating said chamber with the atmosphere at a zone of said chamber adjacent an end of said reel and on the longitudinal axis thereof; a cover movably mounted on said housing, a first position of said cover being over the exterior of said shear plate whereby access to said chamber through the openings thereof is closed and access to said chamber through said conduit is provided, a second position of said cover being within said housing whereby access to said chamber through said conduit is closed and access to said chamber through the openings of said shear plate is provided; and means associated with said cover to open said bore when said cover is in said first position and to close said bore when said cover is in said second position.

7. A dry shaver according to claim 6 wherein said means for rotating said reel comprises an electric motor and a gear train connecting said electric motor to said reel.

8. A dry shaver according to claim 6 wherein said means associated with said cover to open and close said bore is an integral lateral extension of said cover, having an aperture therein, said aperture being aligned with said bore when said cover is in said first position and said aperture being misaligned with said bore when said cover is in said second position.

9. A dry shaver according to claim 6 which additionally includes a power-take off for oscillating motion which comprises a mount on said housing for receiving an oscillating tool shank and means for oscillating said mounted shank.

* * * * *